US006435916B1

(12) United States Patent
Amberg et al.

(10) Patent No.: US 6,435,916 B1
(45) Date of Patent: Aug. 20, 2002

(54) ELECTRICAL POWER CONNECTOR FOR PRINTED CIRCUIT BOARDS

(75) Inventors: Mark F. Amberg, Singapore (SG); Woong K. Yoon, Westminster, CO (US); Gary L. Griffith, Arvada, CO (US); David A. Norte, Westminster, CO (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/605,445

(22) Filed: Jun. 28, 2000

(51) Int. Cl.[7] ..... H01R 25/00

(52) U.S. Cl. ..... 439/651; 439/549; 439/557; 439/620

(58) Field of Search ..... 439/651, 654, 439/133, 214, 620, 606, 105, 106, 549, 552

(56) References Cited

U.S. PATENT DOCUMENTS

| | | | | | |
|---|---|---|---|---|---|
| 2,891,103 | A | * | 6/1959 | Swengel | 174/153 |
| 3,671,921 | A | * | 6/1972 | Baker, III et al. | 339/59 M |
| 5,788,521 | A | * | 8/1998 | Milan | 439/214 |
| 6,086,422 | A | * | 7/2000 | Glynn | 439/620 |

* cited by examiner

*Primary Examiner*—Tho D. Ta
*Assistant Examiner*—Phuong Nguyen
(74) *Attorney, Agent, or Firm*—Patton Boggs LLP

(57) ABSTRACT

A snap mounted electrical power connector for a printed circuit board. The electrical power connector is included of an input power receptacle that forms a first portion of a current carrying path through the electrical power connector and an output power receptacle that forms a second portion of the current carrying path through the electrical power connector. The input power receptacle and the output power receptacle are configured to connect along a common axis perpendicular to the printed circuit board by a snap connection.

11 Claims, 6 Drawing Sheets

ELECTRICAL POWER CONNECTOR FOR PRINTED CIRCUIT BOARDS

FIELD OF THE INVENTION

The invention relates to electrical power connectors, and more particularly, to a snap mounted electrical power connector for a printed circuit board that connects along a common axis.

PROBLEM

Power connectors are required to bring power to printed circuit (PC) boards. These power connectors generally include two individual power receptacles that mount on opposing sides of the PC board. Each receptacle is mounted on its respective side of the PC board using screws or other similar fasteners. The receptacles are mounted in an offset configuration that prevents the mounting of one receptacle from interfering with the mounting of the other receptacle. The input receptacle mounted on the back plane of the PC board includes three male electrical contacts that mate with a line, neutral, and ground electrical receptacles of an external power cord leading to a wall socket. The output receptacle mounted on the front plane of the PC board includes a line, neutral, and ground receptacle configured to receive the male contacts of an internal power cord. The internal power cord is soldered at its opposing end to the PC board.

Electrical leads that extend from the backside of each receptacle and pass through apertures in the PC board provide an electrical connection between the two receptacles. Copper tracers printed on the PC board connect the corresponding electrical leads for each receptacle to complete a circuit. In some cases an electrical filter is used to filter noise generated by the power supply. The filter is typically mounted on the PC board at the connection point of the internal power cord and the PC board.

Unfortunately, the above-described configuration presents several problems in the art. One problem is the physical space occupied by the offset mounting configuration. The physical space occupied by any one component on a PC board is an important concern because of the demand for smaller electronic products. The offset configuration of the individual receptacles utilizes approximately four square inches of space on the front and back plane of the PC board. Another problem with this configuration is that the electrical leads that pass through the PC board pose a danger of electrical shock to individuals working on the PC board. To prevent injury a non-conductive foam padding is often pressed onto the leads. This padding, however, is easily detached and lost. Finally, another problem with this configuration is that the PC board is easily damaged during mounting of the power receptacles due to careless workers over tightening the fastening screws.

SOLUTION

The present invention overcomes the problems outlined above and advances the art by providing a snap mounted electrical power connector that mounts on a PC board along a common axis. A first advantage of the present power connector is that the mounting along the common axis significantly reduces the amount of space utilized by the power connector. A second advantage of the present power connector is that it mounts by a snap connection onto the PC board without the use of independent fasteners or adhesives. A third advantage of the present power connector is that it eliminates the need for the electrical leads, tracers, and non-conductive foam padding, resulting in a safer connector with lower manufacturing costs. A fourth advantage of the present power connector is that in some examples, it includes an internal electrical filter that filters radio frequency interference from a power cord. Advantageously, the internal filter eliminates the need for a separate filter mounted on the PC board resulting in further space savings. A fifth advantage of the present power connector is that the snap mounting provides a faster and easier method of assembly.

The electrical power connector is comprised of an input power receptacle that forms a first portion of a current carrying path through the connector and an output power receptacle that forms a second portion of the current carrying path through the connector. The input power receptacle and the output power receptacle are configured to connect to the PC board by a snap connection along a common axis perpendicular to the board.

In some examples of the present power connector, the input power receptacle and the output power receptacle are contained in a single housing that fits into an aperture formed in the PC board. The power connector could snap into the aperture or be connected in the aperture by loose or captive hardware. In other examples of the present power connector the input power receptacle and the output power receptacle are contained in separate housings that connect together along the common axis from opposing sides of the PC board. The input power receptacle and the output power receptacle could connect together along the common axis by a snap connection or using the loose or captive hardware.

DETAILED DESCRIPTION

Figure 1:
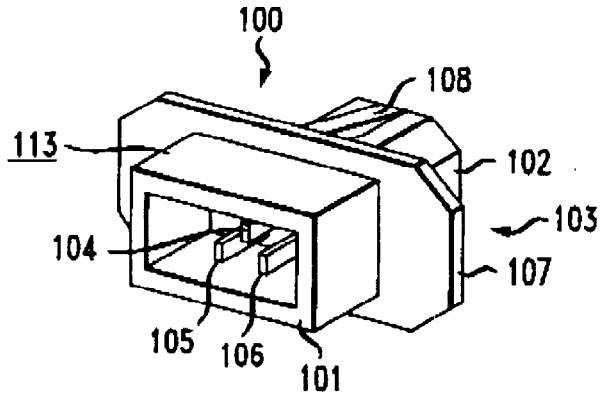
FIG. 1, illustrates a perspective view of an example of an electrical power connector according to the present invention.
Figure 2:
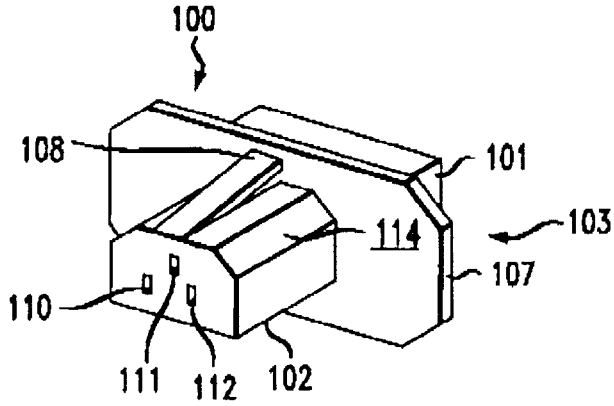
FIG. 2 illustrates another perspective view of the electrical power connector of FIG. 1.
Figure 3:
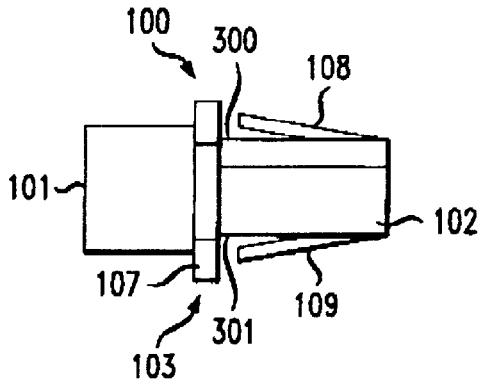
FIG. 3 illustrates a plan view of the electrical power connector of FIG. 1.

FIGS. 1–3 illustrate an example of an electrical power connector 100 according to the present invention. The power connector 100 comprises an input power receptacle 101 and an output power receptacle 102 integrally formed in a single housing 103. The input power receptacle 101 includes line, neutral and ground electrical contacts 104, 105, and 106. The line, neutral and ground contacts 104–106 are housed in shell 113 and form a first portion of a current caring path through the electrical power connector 100. The input power receptacle 102 is configured to receive a conventional external power cord leading to a wall socket. A base plate 107 is integrally formed around the central portion of the housing 103. As will become apparent from the following description, the base plate 107 supports the power connector 100 during connection and disconnection of the external and an internal power cord from the input power receptacle 101 and the output power receptacle 102.

Referring to FIG. 2, the output power receptacle 102 includes line, neutral, and ground electrical receptacles 110, 111, and 112 within housing 114. The line, neutral, and ground electrical receptacles 110–112 are connected to the line, neutral and ground electrical contacts 104–106 and form a second portion of the current caring path through the electrical power connector 100. The line, neutral, and ground electrical receptacles 110, 111, and 112 are configured to receive the male line, neutral, and ground electrical contacts of a conventional internal power cord for a PC board, with one example being an IEC standard three prong PC power cord. Using the principles described above, those skilled in the art will appreciate that in alternative embodiments the input power receptacle 101 and the output power receptacle 102 could be configured other than shown on FIGS. 1–2 to accommodate different power cord designs. For example, the input power receptacle 101 could include any number of electrical contacts and the output power receptacle 102 could include any number of electrical receptacles to accommodate various power cord configurations as a matter of design choice. Similarly, the shell 113 and the housing 114 for the input power receptacle 101 and the output power receptacle 102 could be configured in numerous other shapes to accommodate various power cord configurations as a matter of design choice.

Referring to FIG. 3, a pair of snap connection apparatuses 108 and 109, are integrally formed on a top portion 300 and a bottom portion 301 of the output power receptacle 102. Connecting apparatuses 108 and 109 mount the power connector 100 to a PC board by way of a snap connection. In alternative examples of the present power connector, the connecting apparatuses 108 and 109 could be integrally formed in the input power receptacle 101 as a matter of design choice. Furthermore, the snap connection apparatuses 108 and 109 could be integrally formed on a left and a right side of either the output power receptacle 102 or the input receptacle 101 to avoid interference with other components on a PC board. Alternatively, any suitable form of connection could be used in conjunction with or in place of the snap connection apparatuses 108 and 109. Some examples include without limitation, an adhesive connection, compression connection or the use of loose or captive hardware, such as, nuts, bolts and/or screws.

Figure 4:
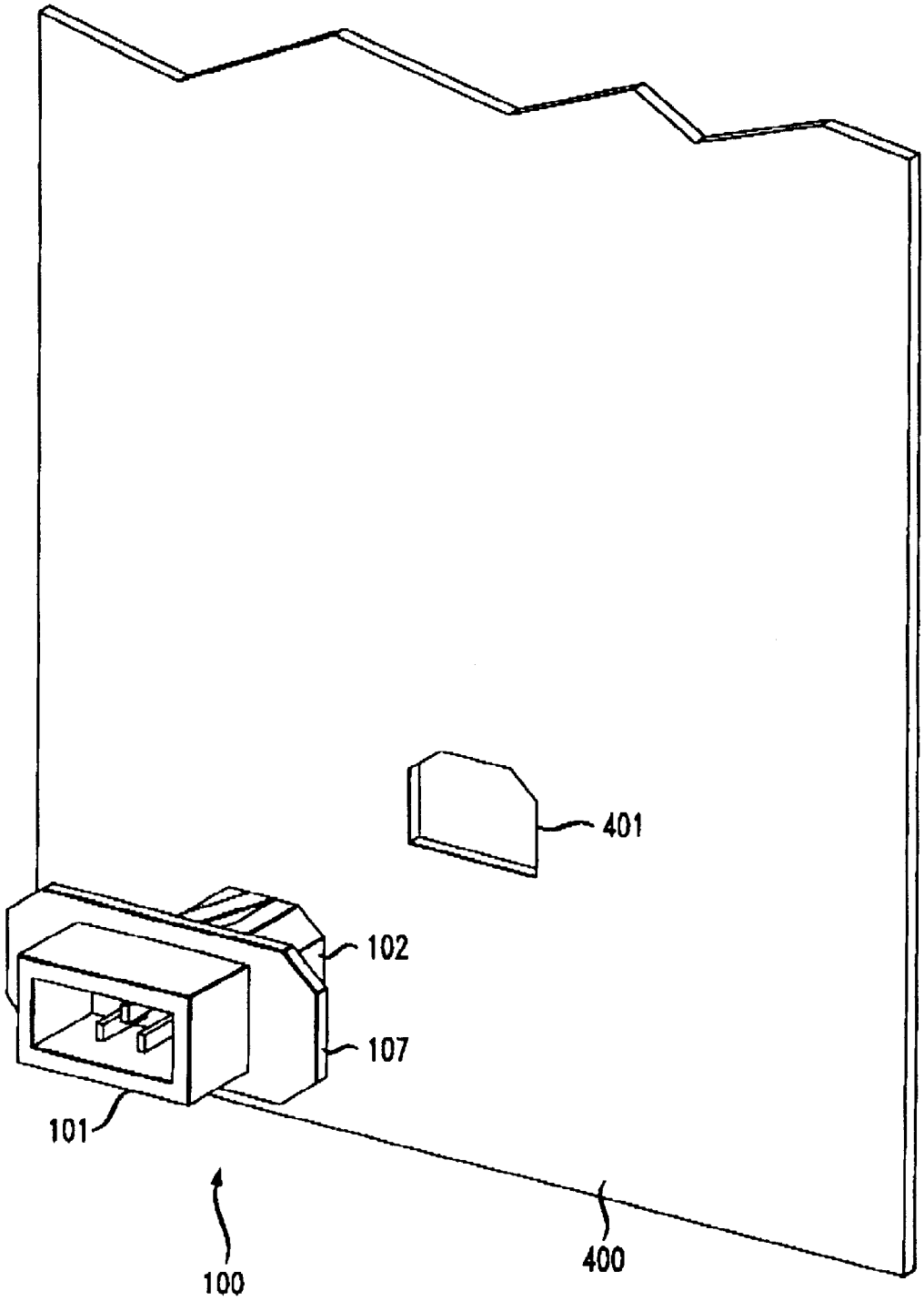
FIG. 4 illustrates the mounting of the electrical power connector of FIG. 1 on a PC board.
Figure 5:
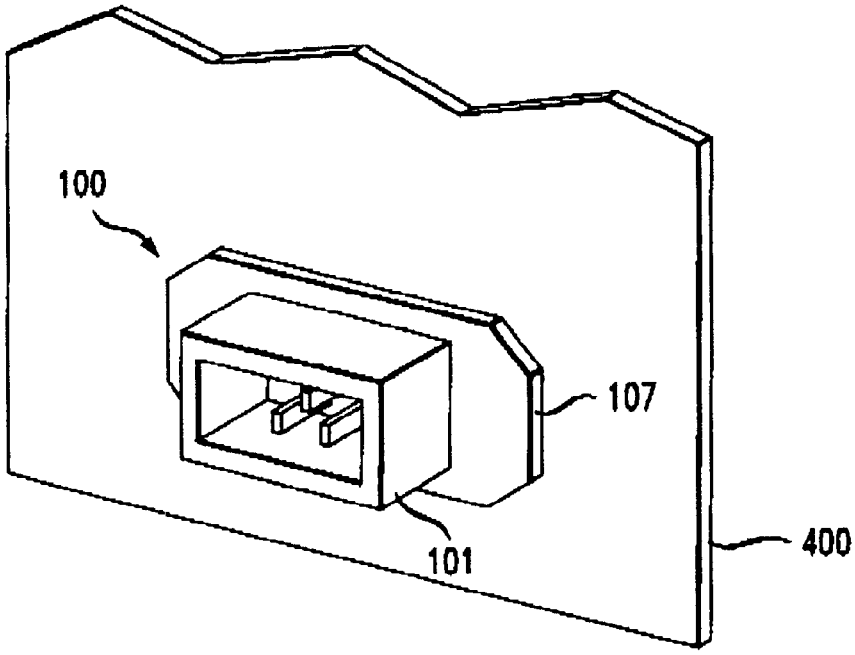
FIG. 5 is another illustration of the mounting of the electrical power connector of FIG. 1 on a PC board.
Figure 6:
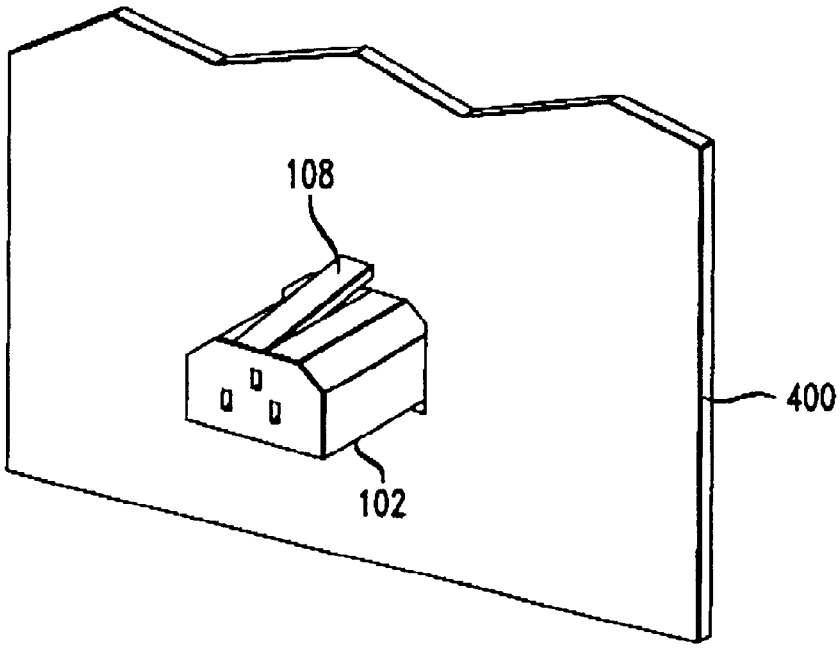
FIG. 6 is another illustration of the mounting of the electrical power connector of FIG. 1 on a PC board.

FIGS. 4–6 illustrate the mounting of the power connector 100 on a PC board 400. The power connector 100 mounts on the PC board 400 by way of a snap connection. An aperture 401 configured in substantially the shape of the output power receptacle 102 is formed in the PC board 400. The output power receptacle 102 is inserted into the aperture 401, as illustrated by FIG. 4, until the snap connection apparatuses 108 and 109 snap through the aperture 401 as illustrate by FIGS. 5 and 6. The snap connection apparatuses 108 and 109 operate to secure the power connector 100 to the PC board 400 by sandwiching the PC board 400 between the snap connection apparatuses 108 and 109 and the base plate 107. Advantageously, the power connector 100 mounts along a common axis perpendicular to the PC board 400, as opposed to the prior art, which mounts in an offset configuration.

The power connector 100 can be detached from the PC board 400 by compressing the snap connection apparatuses 108 and 109 inward toward the top portion 300 and bottom portion 301 of the main body 103 and pushing the power connector 100 out of the aperture 401. Advantageously, the base plate 107 mounts flush with the PC board 400 to support the power connector 100 during connection and disconnection of power cords to and from the input power receptacle 101 and the output power receptacle 102. Those skilled in the art will appreciate that the base plate 107 could be configured in numerous different geometries and dimensions as a matter of design choice. For example, if it is anticipated that electrical cords will be connected and disconnected several times over the course of the life of the power connector 100, the base plate 107 could be larger to provide additional support. Similarly, in space critical applications, the base plate 107 could be smaller to maximize the available space on the PC board 400.

Figure 7:
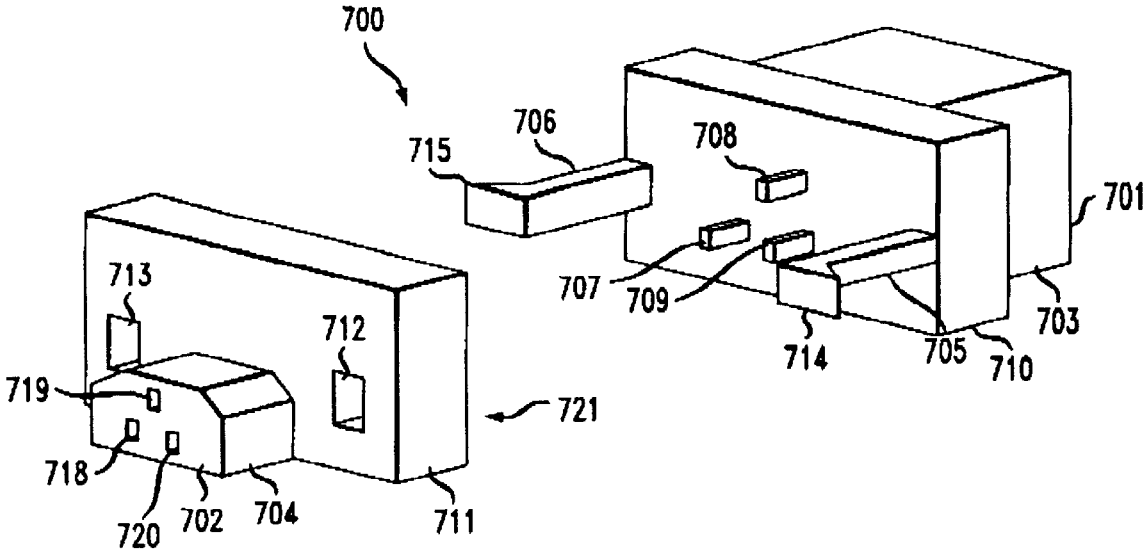
FIG. 7 illustrates a perspective view of another example of an electrical power connector according to the present invention.
Figure 8:
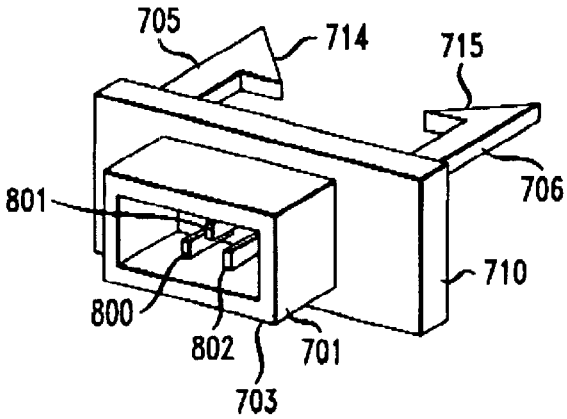
FIG. 8 illustrates another perspective view of the electrical power connector of FIG. 7.

FIGS. 7 and 8 depict another example of a power connector 700 according to the present in invention. Those skilled in the art will appreciate that various features described below could be combined with the above described embodiment to form multiple variations of the invention.

The power connector 700 is comprised of an input power receptacle 701 and an output power receptacle 702. The input power receptacle 701 includes pins 707, 708, and 709, electrical contacts 800, 801, and 802, connecting posts 705 and 706, and a base plate 710. The output power receptacle 702 comprises line, neutral, and ground electrical receptacles 718, 719, and 720, and an integrally formed base plate 711. In operation, the power connector 700 is similar to the power connector 100 except that the input power receptacle 701 is contained in a first housing 703 and the output power receptacle 702 is contained in a second housing 704.

In this example, the pins 707–709 are connected to the electrical contacts 800–802 and together with the electrical contacts 800–802 form the first portion of the current caring path. The line, neutral, and ground electrical receptacles 718–720, in the output power receptacle 702, form the second portion of the current caring path. The pins 707–709 provide the electrical connection between the electrical contacts 800–802 and the line, neutral, and ground electrical receptacles 718–720. The pins 707–709 insert into mating electrical vias formed in the backside 721 of the output power receptacle 702 during the connection of the input power receptacle 701 and output power receptacle 702. Those skilled in the art will readily understand the electrical connection between the pins 707–709 and the electrical receptacles 718–720.

The connecting posts 705 and 706 are integrally formed in the input power receptacle 701 perpendicular to the base plate 710. The connecting posts 705 and 606 are configured to mate with the apertures 712 and 713 formed in the base plate 711 of the output power receptacle 702. The connecting posts 705 and 706 include triangular tips 714 and 715 that are configured to snap into apertures 712 and 713 to connect the input power receptacle 701 and output power receptacle 702. The triangular tips 714 and 715 operate similar to the snap connecting apparatuses 108 and 109 in that they are compressed into the apertures 712 and 713 and expand outward once fully inserted. Similarly, the input power receptacle 701 and the output power receptacle 702 are easily disconnected by compressing the triangular tips 714 and 715 and disengaging the tips 714 and 715 from the apertures 712 and 713. Advantageously, the posts 705 and 706 can be constructed in various lengths to accommodate different PC board thickness. Alternatively, any suitable connecting apparatus could be used in conjunction with posts 705 and 706 or in place of posts 705 and 706. Some examples include an adhesive connection and/or the use of loose or captive hardware.

Figure 9:
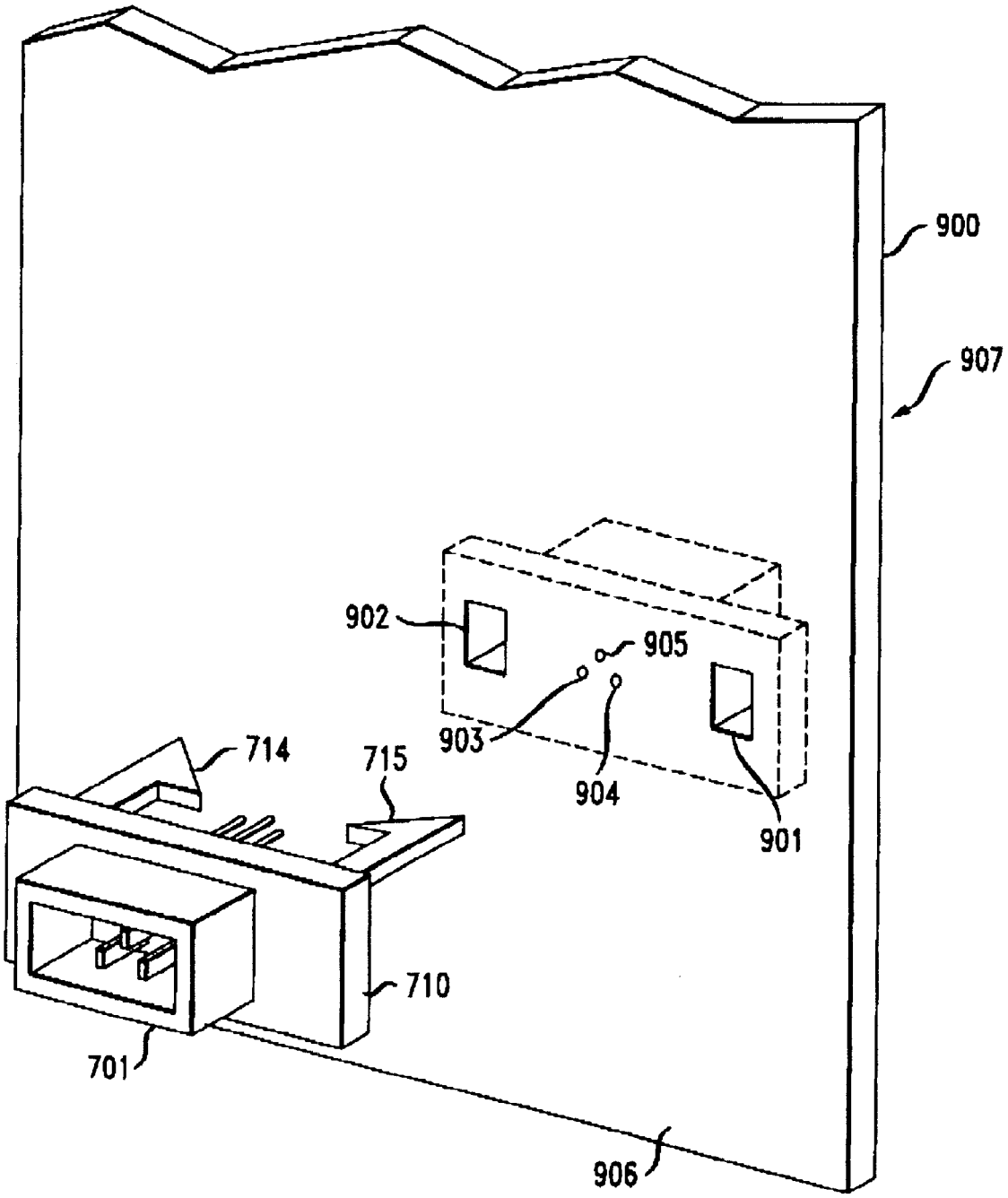
FIG. 9 illustrates the mounting of the electrical power connector of FIG. 7 on a PC board.
Figure 10:
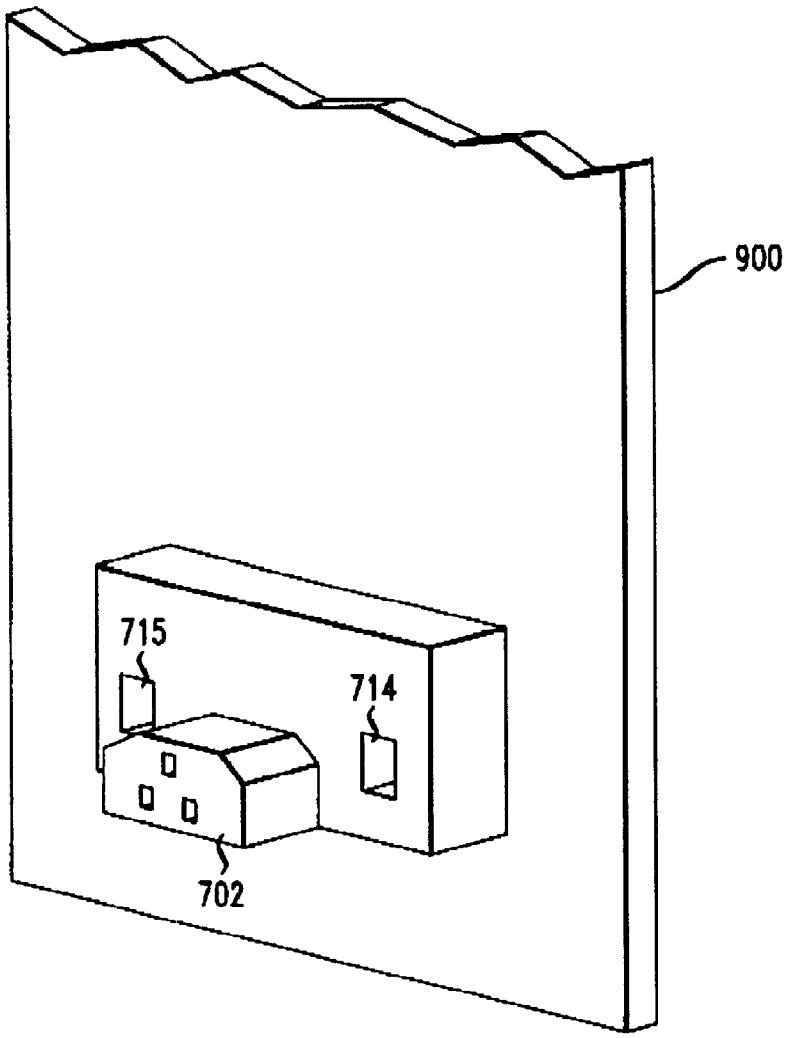
FIG. 10 is another illustration of the mounting of the electrical power connector of FIG. 7 on a PC board.

FIGS. 9 and 10 illustrate the mounting of the power connector 700 to a PC board 900. On FIG. 9 apertures 901, 902, 903, 904 905 are formed in the PC board 900. The apertures 903–905 are configured to receive the pins 707–709. The apertures 901 and 902 are configured to receive the connecting posts 705 and 706. During connection, the pins 707–709 and connecting posts 705 and 706 insert through the apertures 901–905 to mate with the output power receptacle 702. The output power receptacle 702 is connected onto the back plane of the PC board 900 by the snap connection between the posts 714 and 715 and apertures 712 and 713. Advantageously, the power connector 700 mounts on the PC board 900 along a common axis perpendicular to the PC board 900. Also, advantageously, the base plates 710 and 711 support the power connector 700 from both the front plane 906 and the back plane 907 during connection and disconnection of power cords. Another advantage of this example is that the structural integrity of the PC board 900 is better maintained because less material is removed to accommodate the mounting of the power connector 700. Those skilled in the art will appreciate that the base plates 710 and 711 could be configured in numerous different geometries and dimensions as a matter of design choice.

Figure 11:
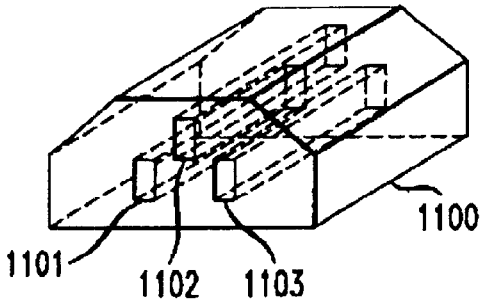
FIG. 11 illustrates a perspective view of a filter for an electrical power connector according to the present invention.

FIG. 11 illustrates an example of a filter 1100 for a power connector e.g. 100 or 700 according to the present invention. Those skilled in the art will appreciate that various features described below could be combined with the above described embodiment to form multiple variations of the invention.

The filter 1100 is comprised of a lossy non-conductive ferrite block configured for insertion into the input power receptacle 102 or 701 of a power connector 100 or 700 according to the present invention. The filter 1100 includes receptacles 1101, 1102, and 1103 that accommodate the conductive path of the electrical receptacles 110–112 or 718–720 in the power connectors 100 or 700. The filter 1100 protects electronic equipment mounted on a PC board from radio frequency interference (RFI) conducted through an AC power cord. Advantageously, incorporation of the filter 1100 into the power connector 100 or 700 provides low cost RFI filtering and eliminates the need for an external filter resulting in further space utilization and efficiencies on a PC board.

Those skilled in the art will appreciate variations of the above-described embodiments that fall within the scope of the invention. As a result, the invention is not limited to the specific examples and illustrations discussed above, but only by the following claims and their equivalents.

What is claimed is:

1. An electrical power connector for a printed circuit (PC) board comprising:

an input power receptacle comprising a first portion of a current carrying path through the electrical power connector, wherein the first portion of the current carrying path comprises a line electrical contact, a neutral electrical contact, and a ground electrical contact being configured to mate with a line receptacle, a neutral receptacle, and a ground receptacle of an external modular three conductor power cord leading to a wall socket;

an output power receptacle comprising a second portion of the current carrying path through the electrical power connector, wherein the second portion of the current carrying path comprises a line receptacle, a neutral receptacle, and a ground receptacle connected to a line contact, a neutral contact, and a ground contact, respectively, of an internal modular three conductor power cord;

a lossy non-conductive ferrite block internally housed in the input power receptacle; and means for mounting the input power receptacle and the output power receptacle on the printed circuit board along a common axis, such that the line electrical receptacle is connected to the line electrical contact, the neutral electrical receptacle is connected to the neutral electrical contact and the ground electrical receptacle is connected to the ground electrical contact.

2. The connector of claim 1, wherein the line electrical receptacle is configured to detachably connect to the line electrical contact, the neutral electrical receptacle is configured to detachably connect to the neutral electrical contact, and the ground electrical receptacle is configured to detachably connect to the ground electrical contact.

3. The connector of claim 1, wherein the input power receptacle is in a first housing and the output power receptacle is in a second housing.

4. The connector of claim 3, further comprising:

means within the first housing for supporting the power connector during connection and disconnection of the external power cord; and means within the second housing for supporting the power connector during connection and disconnection of the external power cord.

5. The connector of claim 4, wherein the support means in the first housing comprises:

a first base plate integrally formed in the first housing in a perpendicular orientation to the input power receptacle.

6. The connector of claim 5, wherein the support means in the second housing comprises:

a second base plate integrally formed in the second housing in a perpendicular orientation to the output power receptacle.

7. The connector of claim 6, wherein the mounting means comprises:

a pair of posts connected perpendicular to one of the first base plate and the second base plate; and a pair of apertures defined in the other one of the first base plate and the second base plate, wherein the pair of apertures are configured to mate with the pair of posts to form a snap connection between the first housing and the second housing.

8. The connector of claim 1, wherein the input power receptacle and the output power receptacle are in a single housing.

9. The connector of claim 8, wherein the mounting means comprises:

a pair of snap connection apparatuses integrally formed on opposing sides of the single housing.

10. The connector of claim 8, further comprising:

means within the single housing for supporting the power connector during connection and disconnection of the external power cord.

11. The connector of claim 10, wherein the means within the single housing for supporting comprises:

a base plate integrally formed around a central portion of the single housing.

* * * * *